US005487334A

United States Patent [19]

Chew et al.

[11] Patent Number: 5,487,334

[45] Date of Patent: Jan. 30, 1996

[54] APPARATUS FOR PRODUCING CHARACTERS ON A PRODUCT

[75] Inventors: Ralph M. Chew, New Kensington; Robert W. Ekis, Pittsburgh, both of Pa.

[73] Assignee: Matthews International Corporation, Pittsburgh, Pa.

[21] Appl. No.: 22,557

[22] Filed: Feb. 25, 1993

[51] Int. Cl.[6] ..... B05C 17/06

[52] U.S. Cl. ..... 101/126; 101/127; 101/127.1

[58] Field of Search ..... 101/129, 127, 101/127.1, 119, 41, 163, 112, 128, 114, 126; 346/140 R; 347/86

[56] References Cited

U.S. PATENT DOCUMENTS

| | | | |
|---|---|---|---|
| 3,656,428 | 4/1972 | Duncan | 101/129 |
| 3,949,660 | 4/1976 | Zimmer | 101/120 |
| 4,137,842 | 2/1979 | Miller | 101/127 |
| 4,306,243 | 12/1981 | Taub et al. | 346/75 |
| 4,561,789 | 12/1985 | Saito | 101/114 |
| 4,612,554 | 9/1986 | Poleshuk | 346/140 R |
| 4,702,165 | 10/1987 | Anderson | 101/114 |
| 4,730,556 | 3/1988 | Cobbs, Jr. | 101/129 |
| 4,814,786 | 3/1989 | Hoisington et al. | 346/140 R |
| 4,929,109 | 5/1990 | Ikenaga | 101/134 |
| 5,050,498 | 9/1991 | Smith | 101/127.1 |
| 5,232,544 | 8/1993 | Sumi | 101/123 |
| 5,340,388 | 8/1994 | Breton et al. | 106/22 B |
| 5,381,172 | 1/1995 | Ujita et al. | 347/86 |

OTHER PUBLICATIONS

Licensing Report Dated May 9, 1989, Titled: The Inventions Of Michael Sullivan Smith, pp. 1–18.

*Primary Examiner*—Edgar S. Burr
*Assistant Examiner*—John S. Hilten
*Attorney, Agent, or Firm*—James Ray & Associates

[57] ABSTRACT

A marking head assembly having a body portion. An aperture formed through such body portion having an ink cartridge assembly disposed therein. A heating element carried by the body portion to heat the ink cartridge assembly to a predetermined temperature capable of melting an ink supply. A heat control device connected to the heating element to control temperature. A locking device is secured to the body portion which engages the ink cartridge assembly to lock it in position and to prevent longitudinal movement when in the body portion of the marking head assembly. A cap assembly is engaged with the body portion adjacent one end of the ink cartridge assembly to enable pneumatic pressure to be supplied to such ink cartridge assembly. There is a marking tip assembly carried by the second end of such cartridge assembly.

14 Claims, 2 Drawing Sheets

APPARATUS FOR PRODUCING CHARACTERS ON A PRODUCT

FIELD OF THE INVENTION

The present invention relates, in general, to equipment for marking products for identification and/or other purposes and, more particularly, this invention relates to a more versatile apparatus for producing predetermined characters on predetermined surface areas of a product.

BACKGROUND OF THE INVENTION

Prior to the present invention, it has been known to apply marks to a product for inspection and/or identification purposes. However, with the equipment available to a manufacturer of these products to be marked, application of such identification or inspection marks were often difficult to achieve and generally expensive.

Typical marking devices in use at the present time are mechanical and include numerous component parts which are subject to excessive wear. Obviously, such wear adds to the cost of applying a mark to a product due to excessive maintenance requirements.

Further, these prior art marking devices utilize liquid inks which may have a relatively long drying time. Excessive drying time often times will result in the mark being smeared during subsequent handling of the product. In order to overcome this problem, it is more or less the practice to provide drying stations or tunnels. This prior art practice obviously adds to the cost of applying a mark to a product.

To overcome this problem, some manufacturers utilize inks which have a rather rapid drying time. However, these rapid drying inks utilize solvents which can create health and environmental problems.

In many production facilities space for marking devices is limited. Such space limitations create significant difficulty in both installing and maintaining the marking equipment. Another problem associated with the use of marking devices requiring liquid ink is that significant time is involved in start-up and subsequent clean up of the equipment.

Prior art marking devices also include, what is commonly known in the art as, foil leaf printers. Foil leaf printers have the drawback that their is a considerable amount of waste material, i.e., foil. Further, these foil leaf printers are somewhat complex in design and require the use of a relatively high force in order to transfer the mark to the product. Often times such high force results in damage, particularly, to delicate products. The product damage in this manner obviously adds to the cost of manufacturing these products.

Other prior art marking devices include spray or ink jet non-contact printers. These non-contact printers usually produce a lower quality mark and lack opacity on dark colored objects which may be objectionable.

The solvent based inks used in all of the above devices create potentially serious fire hazards and require special handling, shipping and storage.

SUMMARY OF THE INVENTION

The present invention provides an apparatus for producing predetermined characters on a variety of products.

In a first aspect, the present invention provides a marking tip assembly for applying a predetermined character to a predetermined surface of a predetermined article. According to the present invention, such marking tip assembly includes a body portion engageable with one end of an ink cartridge assembly. The body portion has an aperture formed therethrough substantially along a longitudinal axis thereof. A porous disk member is disposed at an outer end of such body portion. Disposed over such porous disk member is a screen means for providing the preselected character to be applied to such predetermined surface of the preselected article. A means engageable with such screen means is provided to hold the screen means in proper orientation during a marking cycle. A plunger means is mounted for reciprocal movement within the aperture formed in the body portion for forcing a predetermined amount of melted ink through the porous disk member and the screen means. A sealing means is disposed adjacent one end of such plunger means for sealing an ink supply to the porous disk member when such marking tip is setting idle.

In a second aspect, the present invention provides an ink cartridge assembly for supplying ink to a marking tip of a printing assembly used to place a predetermined character on a predetermined surface of a predetermined article. In this embodiment, such ink cartridge assembly includes an elongated body portion having an aperture formed therethrough substantially along a longitudinal axis thereof. Disposed on an outer surface of such body portion, adjacent one end thereof, is a sealing means for preventing leakage of fluid pressure from such ink cartridge assembly when it is pressurized. Another means is disposed on the outer surface of such body portion which prevents longitudinal movement of the ink cartridge assembly. There is an ink filtering means disposed within the aperture in the body portion which prevents clogging of a marking tip assembly.

In a final embodiment, the present invention provides a marking head assembly for use with a marking apparatus which applies at least one predetermined character to at least one predetermined surface of at least one predetermined article being marked. Such marking head assembly includes a body portion having a predetermined configuration. An aperture is formed through such body portion along a predetermined axis thereof. An ink cartridge assembly is disposed within such aperture formed in the body portion of such marking head assembly. A heating means is carried by the body portion which applies heat to such ink cartridge assembly at a temperature which is at least sufficient to melt ink contained within such ink cartridge assembly. A heat control means is connected to such heating means for controlling the temperature applied to the ink cartridge assembly. A locking means is secured to the body portion which is engageable with the ink cartridge assembly to enable locking such ink cartridge assembly in position and thereby prevent longitudinal movement of such ink cartridge assembly within the body portion of such marking head assembly. There is a cap assembly engageable with the body portion adjacent one end of the ink cartridge assembly for supplying a predetermined volume of pneumatic pressure to such ink cartridge assembly. The final essential element is a marking tip assembly carried by a second end of such ink cartridge assembly.

OBJECTS OF THE INVENTION

It is, therefore, one of the primary objects of the present invention to provide an apparatus for producing predetermined characters on a predetermined product which utilizes an instant drying ink.

Another object of the present invention is to provide an apparatus for producing predetermined characters on a predetermined product in which the products marked can be handled immediately without accidental damage to the mark applied.

Still another object of the present invention is to provide an apparatus for producing predetermined characters on a predetermined product in which the ink used in the apparatus does not require solvents thereby minimizing health, environmental, fire, shipping, handling and storage problems.

Yet another object of the present invention is to provide an apparatus for producing predetermined characters on a predetermined product in which there are no moving parts in the marking head, thereby significantly reducing maintenance cost.

An additional object of the present invention is to provide an apparatus for producing predetermined characters on a predetermined product in which the apparatus is relatively compact, thereby facilitating installation in a production line.

A further object of the present invention is to provide an apparatus for producing predetermined characters on a predetermined product in which the ink can be quickly and easily replaced within the apparatus by utilizing a refillable ink cartridge assembly thus minimizing production downtime.

Still yet another object of the present invention is to provide an apparatus for producing predetermined characters on a predetermined product in which the pigment based ink utilized in the apparatus provides an opaque or at least semi-opaque mark on the product.

In addition to the various objects and advantages of the present invention discussed above, various other objects and advantages of the invention will become more readily apparent to those persons who are skilled in the marking art from the following more detailed description of such invention, particularly, when such description is taken in conjunction with the attached drawing figures and with the appended claims.

Figure 1:
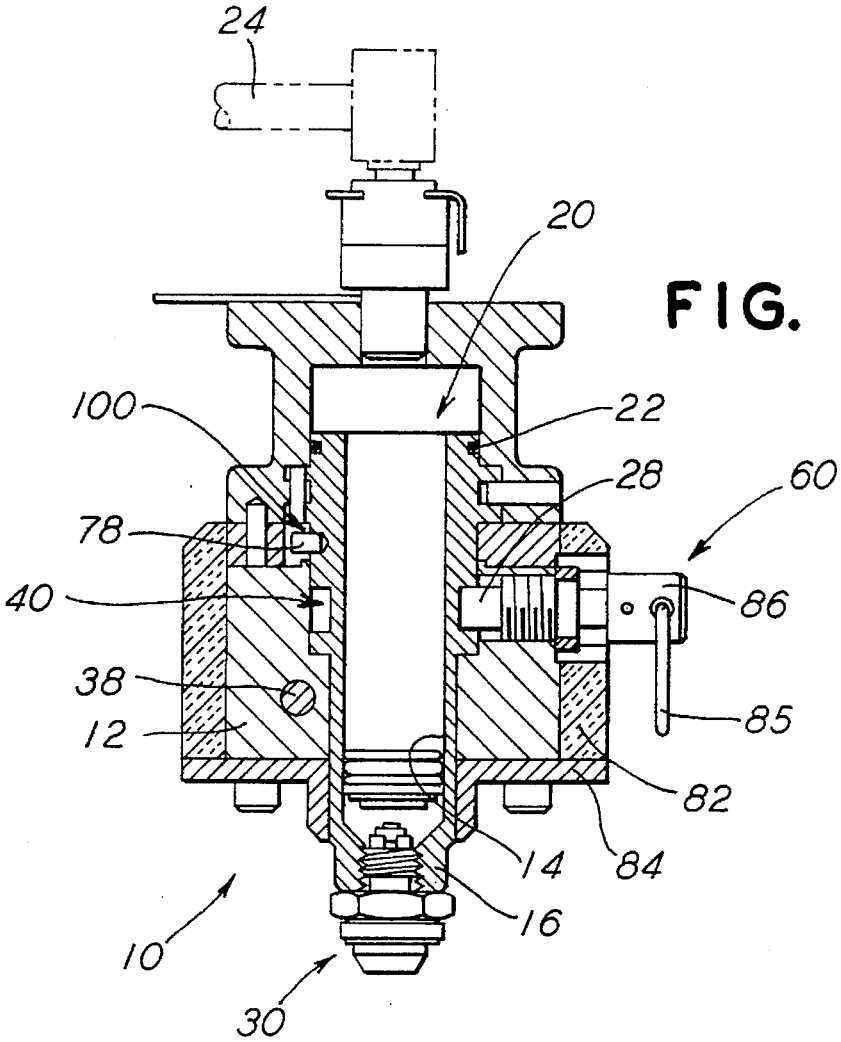
FIG. 1 is a side elevation view, partially in cross-section, of a marking head assembly constructed according to a presently preferred embodiment of the invention.
Figure 2:
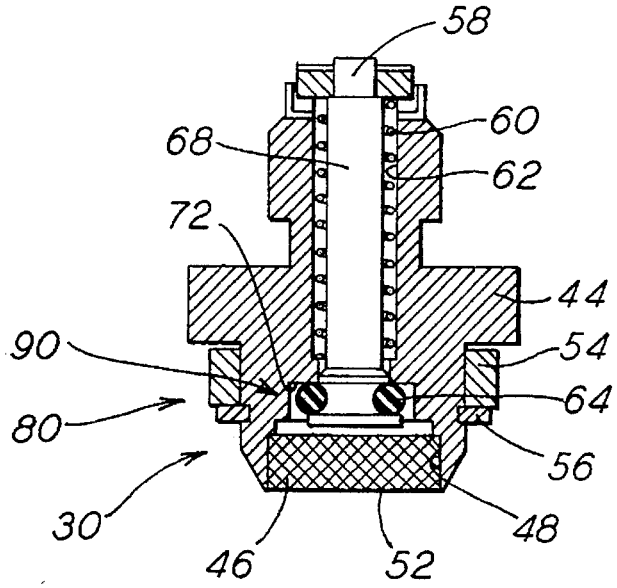
FIG. 2 is a side elevation view, partially in cross-section, of a presently preferred marking tip assembly constructed according to a presently preferred embodiment of the invention.
Figure 3:
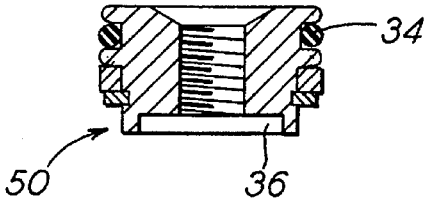
FIG. 3 is a side elevation view, partially in cross-section, of a filter assembly constructed according to a presently preferred embodiment of the invention.
Figure 4:
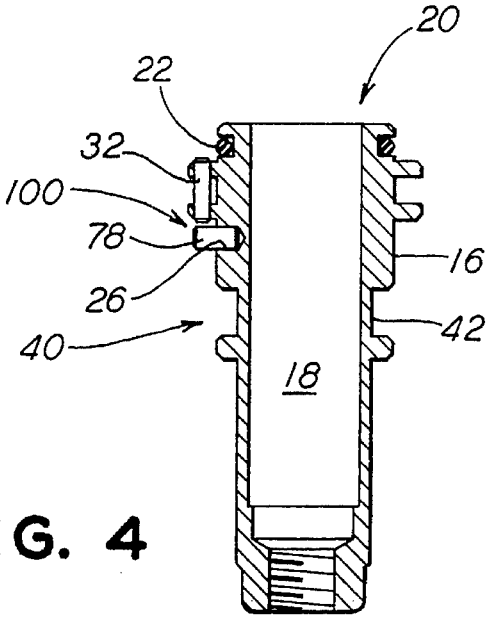
FIG. 4 is a side elevation view, partially in cross-section, of an ink cartridge assembly constructed according to one embodiment of the invention.

DESCRIPTION OF A PRESENTLY PREFERRED AND ALTERNATIVE EMBODIMENT OF THE PRESENT INVENTION

Prior to proceeding to the more detailed description of the present invention, it should be understood that, for the sake of clarity, identical components having identical functions have been identified with identical reference numerals throughout the several views of the drawings.

Now refer, more particularly, to FIGS. 1 through 6. Illustrated therein is a marking head assembly, generally designated 10, for use with a marking apparatus (not shown) which applies at least one predetermined character to at least one predetermined surface of at least one predetermined article to be marked. The marking apparatus indicated as not being illustrated includes a mounting bracket for the marking head assembly 10, a source of fluid pressure and the necessary electrical controls. These particular items do not form a part of the present invention and therefore will not be discussed in any great detail hereinafter.

The marking head assembly 10 includes a body portion 12 having a predetermined configuration. Such predetermined configuration of body portion 12, in the presently preferred embodiment of the invention, will generally be cylindrical. An aperture 14 is formed through the body portion 12 along a predetermined axis thereof.

An ink cartridge assembly, generally designated 20, is disposed within the aperture 14 formed in such body portion 12 of the marking head assembly 10. Such ink cartridge assembly 20 is used for supplying ink to a marking tip, generally designated 30, of the marking head assembly 10. Ink cartridge assembly 20 includes an elongated body portion 16 having an aperture 18 formed therethrough substantially along a longitudinal axis thereof. A sealing means 22 is disposed on an outer surface of the body portion 16 adjacent one end thereof. Preferably, this sealing means 22 is an O-ring provided to prevent leakage of fluid pressure from the ink cartridge assembly 20 when it is pressurized via line 24. Additionally, in the presently preferred embodiment, the body portion 16 of the ink cartridge assembly 20 will generally be cylindrical.

A means, generally designated 40, is disposed on an outer surface of the body portion 16 of ink cartridge assembly 20 for preventing longitudinal movement of such ink cartridge assembly 20 when it is disposed in the aperture 14 of the marking head assembly 10. Such means 40 includes an aperture 26 formed in the outer surface of the body member 16 and pin member 28. Pin member 28 is engageable in aperture 26 of body portion 16 and in the body portion 12 of the marking head assembly 10.

Further, the ink cartridge assembly 20 includes a filter assembly, generally designated 50, disposed within the aperture 18 of the body portion 16. Ink filtering means 50 is provided to prevent contamination and clogging of the marking tip assembly 30.

In the presently preferred embodiment of the invention, a pin member 32 is engaged with the outer surface of the body portion 16 of ink cartridge assembly 20 to limit rotation of cap assembly 70.

Also, in the presently preferred embodiment of the invention, the filtering means 50 includes at least one sealing means, preferably an O-ring 34, disposed on an outer surface thereof for sealing such filtering means 50 against a surface of the aperture 18 formed in body portion 16 of the ink cartridge assembly 20. This arrangement ensures the ink being passed from the ink cartridge assembly 20 is passed through the filtering means 50. In the presently preferred embodiment of the invention, the filtering means 50 has a fine metal screen 36 disposed at one end thereof which is the end nearest the marking tip assembly 30.

Marking head assembly 10 includes a heating means 38. Heating means 38 is disposed in the body portion 12 of marking head assembly 10 for heating the ink cartridge assembly 20 to a predetermined temperature which is at least sufficient to melt a solid ink contained within such ink cartridge assembly 20. A heat control means, such as a thermocouple, is connected to such heating means to provide control of the temperature.

According to this embodiment of the invention, a locking means, generally designated 60, is secured to the body portion 12 of the marking head assembly 10 and engages a groove 42 disposed in the outer surface of body portion 16 of the ink cartridge assembly 20. Locking means 60 locks the ink cartridge assembly 20 in position in the marking head assembly 10 and prevents longitudinal movement of such ink cartridge assembly 20 within the body portion 12 of marking head assembly 10.

A cap assembly, generally designated 70, is engageable with the body portion 12 of marking head assembly 10 and is disposed adjacent one end of the ink cartridge assembly 20. Cap assembly 70 enables supplying a predetermined volume of pneumatic pressure to the ink cartridge assembly 20 via air supply tube 24.

A final essential element of the marking head assembly 10 is a marking tip assembly 30 which is carried by the second end of such ink cartridge assembly 20.

Marking tip assembly 30 has a body portion 44 which is engageable with one end of the ink cartridge assembly 20. Such body portion 44 of marking tip assembly 30 has an aperture formed therethrough substantially along a longitudinal axis thereof. A porous disk member 46 is disposed at the outer most end of the body portion 44. In a presently preferred embodiment, such porous disk member 46 is disposed within a recessed portion 48 formed in the end of body portion 44. Further, in the presently preferred embodiment, porous disk member 46 is a metal.

A screen means 52 is disposed over such porous disk member 46. Screen means 52 provides the predetermined character to be applied to the predetermined surface of such predetermined article. In the preferred embodiment of the invention, screen means 52 is formed from a fine metal wire.

A means, generally designated 80, is engageable with the screen means 52 for holding it in proper orientation over such porous disk member 46. In the presently preferred embodiment, means 80, for holding such screen means 52, includes a spacer ring 54 and a retaining ring 56. A plunger means 58 is mounted for reciprocal movement within the aperture 62 formed along a longitudinal centerline of the marking tip assembly 30. When plunger means 58 is open a predetermined amount of melted ink can be forced through both the porous disk member 46 and the screen means 52.

The final essential element of the marking tip assembly 30 is a sealing means, generally designated 90. Sealing means 90 is disposed adjacent one end of the plunger means 58 for sealing an ink supply to the porous disk member 46 and screen means 52 when the marking tip assembly 10 is setting idle. In the presently preferred embodiment, sealing means 80 includes at least one O-ring 64 and a biasing means, such as spring 66, which surrounds the stem 68 of plunger means 58. Spring 66 urges the O-ring 64 into sealing engagement with a ledge portion 72 of the aperture 62 formed through body portion 44 of marking tip assembly 30.

Figure 6:
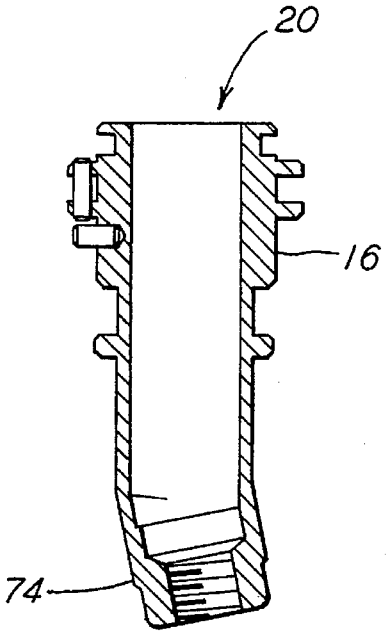
FIG. 6 is a side elevation view, partially in cross-section, of an alternative embodiment of the ink cartridge assembly illustrated in FIG. 4.
Figure 5:
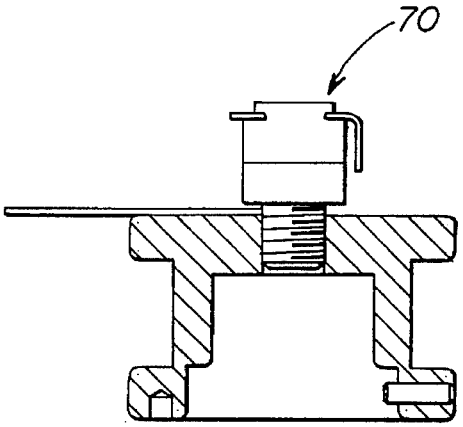
FIG. 5 is a side elevation view, partially in cross-section, of a cap assembly constructed according to a presently preferred embodiment of the invention.

An alternative embodiment of the body portion 16 of ink cartridge assembly 20 is illustrated in FIG. 6. In this embodiment, it can be seen that one end 74 of such body portion 16 is disposed at a predetermined angle, thereby positioning the marking tip assembly 30 at such predetermined angle.

According to one of the more preferred embodiments of the invention, marking head assembly 10 will further includes a registration means, generally designated 100, connected to the body portion 12 of marking head assembly 10 and engageable with the ink cartridge assembly 20 to prevent rotation of ink cartridge assembly 20. Such registration means 100 is required, for example, when using a character which must be oriented in a certain position. Registration means 100 includes a pin 78 disposed in an aperture formed in the body portion 16 of ink cartridge assembly 20 in body portion 12 of marking head assembly 10.

It is also presently preferred, that marking head assembly 10 will include an insulation cover 82 which surrounds the body portion 12 of marking head assembly 10. Such insulation cover 82 is provided to prevent operator contact with body portion 12 of marking head assembly 10 which has been heated by heating means 38.

Likewise, in the presently preferred embodiment, marking head assembly 10 further includes an end cap member 84 which is disposed radially opposite cap assembly 70. End cap assembly 84 is secured to the body portion 12 of marking head assembly 10 to provide insulation and prevent operator contact with heated body portion 12.

Further, marking head assembly 10, in the presently preferred embodiment, includes a plunger guard 86 disposed in a position to cover the metallic end of locking means 60 and prevents heat transfer to pull ring 85 preventing operator from contacting heated metal parts.

It can be seen from the above description that the present invention provides a reciprocating marking system capable of utilizing a non-toxic solid ink which is heated in the ink cartridge assembly to its melting point. The system is capable of producing a solid dot of ink, characters or graphics. The melted ink drys almost instantaneously on contact with the substrate surface being marked, thereby eliminating smearing or offsetting. The system basically consists of a marking head assembly with a removable, refillable ink cartridge and an electrical control enclosure. These units are connected by a conduit which supplies fluid pressure and electrical power to the print head.

As described above, the marking head includes a cylindrical metal housing or body portion which holds the ink cartridge assembly and the heating means to provide sufficient temperature for melting the ink. The heating means is preferably a cartridge heater which can be threaded into the body portion. The heating means has a thermocouple to control the temperature.

The registration ring is secured to the body portion, preferably with screws, and prevents the ink cartridge assembly from rotating. A slot in the registration ring mates with a pin disposed in the ink cartridge assembly thereby providing alignment. Another pin pressed into the registration ring mates with a blind hole in the cap assembly to prevent rotation of such cap assembly for safety reasons. A cover is disposed around the body portion to provide insulation and protection against burns. Such cover is preferably secured to the body portion by screws. An identification and warning label is preferably attached to the cover by means of an adhesive.

A pull ring plunger locks the ink cartridge assembly into position. This pull ring plunger includes a spring loaded pin which engages a groove in the ink cartridge assembly. In order to install or remove the ink cartridge assembly, the pin is retracted against the spring by pulling the ring. A plunger guard covers the metal end of the pull ring plunger which provides thermal insulation and prevents heat transfer to the ring of the plunger thereby minimizing burns. The plunger guard is held in place by a spring pin. A spacer ring provides proper clearance for threading the pull ring plunger into the body portion.

The ink cartridge assembly which contains the heated ink is removable from the marking head assembly for refilling or replacing with another ink cartridge assembly having a different type of ink or color or having different graphics, characters or any combination of the above. An O-ring provides a seal to the cap assembly and prevents air from escaping when the ink cartridge assembly is pressurized. A pin mates with a slot in the registration ring to align the ink cartridge assembly and prevent rotation thereof. This is critical when marking graphics or characters and when mark registration on an item must be maintained. Pins are provided to prevent the cap assembly from being turned more than 90 degrees during installation or removal. The pins in the cap assembly engage the pin in the ink cartridge assembly thereby limiting such rotation of the cap assembly.

The marking tip assembly is preferably threaded into the end of the ink cartridge assembly. Such marking tip assembly produces the mark by extruding melted ink through a porous metal disk recessed in the tip. A fine metal screen covers the face of the disk improving the quality of the mark and also providing a means to produce characters, graphics, etc. via conventional silk screen methods for creating stencil images on screen material. A spacer ring stretches the screen over the tip and a retaining ring holds both the screen and spacer ring in place. To prevent ink leaking from the tip when the unit is not in service an O-ring is mounted on the plunger to seal the passage running axial through the tip. A spring acting on a washer mounted on the end of the plunger and held in place by a retaining ring provides the requisite force to seal the O-ring against it's mating surface.

The cap assembly of this invention is secured over the top of the ink cartridge assembly and allows it to be pressurized with air during the marking cycle. Pins are provided to engage a groove in the ink cartridge assembly and hold the cap assembly in place. A quick connect/disconnect fitting permits the cap assembly to be disconnected and connected to the air supply tube. Preferably, labels are adhered to the cap assembly to alert operators of high temperature danger and provide operational instructions. Further, a tag may be provided to warn against turning the ink cartridge assembly and cap assembly over while such ink cartridge assembly is hot to prevent melted ink from leaking out.

A filter assembly to filter the melted ink is provided to prevent contamination and clogging of the marking tip. A fine metal screen covers the end of the filter body for this purpose. Such screen is stretched over the filter body by a spacer ring and retaining ring which holds both items in place. An O-ring seals the filter assembly against the inner walls of the ink cartridge assembly and holds it in place.

While a number of presently preferred and alternative embodiments of the present invention have been described in considerable detail above it should be understood by those persons who are skilled in the marking art that various other modifications and adaptations of such invention can be made without departing from the spirit or scope of the appended claims.

We claim:

1. A marking tip assembly for applying a predetermined character to a predetermined surface of a predetermined article, said marking tip assembly comprising:

(a) a body portion engageable with one end of an ink cartridge assembly, said body portion having an aperture formed therethrough substantially along a longitudinal axis thereof;

(b) a porous disk member disposed at one end of said body portion;

(c) a screen means disposed over said porous disk member for providing said predetermined character to be applied to said predetermined surface of said predetermined article;

(d) means engageable with said screen means for holding said screen means in proper orientation over said porous disk member;

(e) a plunger means mounted for reciprocal movement within said aperture for enabling a predetermined amount of melted ink to be forced through both said porous disk member and said screen means; and (f) a sealing means disposed adjacent one end of said plunger means for sealing an ink supply to said porous disk member.

2. A marking tip assembly, according to claim 1, wherein said sealing means includes at least one O-ring and a biasing means surrounding said plunger means for urging said O-ring into sealing engagement with a ledge portion of said aperture formed through said body portion.

3. A marking tip assembly, according to claim 1, wherein said body portion includes a recess portion and said porous disk member is disposed within said recess portion.

4. A marking tip assembly, according to claim 3, wherein said porous disk member is metal.

5. A marking tip assembly, according to claim 1, wherein said screen means is fine metal.

6. A marking tip assembly, according to claim 5, wherein said fine metal is wire.

7. A marking tip assembly, according to claim 1, wherein said means for holding said screen means includes both a spacer ring and a retaining ring.

8. A marking tip assembly, according to claim 1, wherein said one end of said body portion having said porous disk member disposed thereon is positioned at an angle to a transverse plane through said longitudinal axis.

9. A marking head assembly for use with a marking apparatus which applies at least one predetermined character to at least one predetermined surface of at least one predetermined article to be marked, said marking head assembly comprising:

(a) a body portion having a predetermined configuration;

(b) an aperture formed through said body portion along a predetermined axis;

(c) an ink cartridge assembly disposed within said aperture formed in said body portion of said marking head assembly;

(d) a heating means carried by said body portion for heating said ink cartridge assembly to a temperature which is at least sufficient to melt ink contained within said ink cartridge assembly;

(e) a heat control means connected to said heating means for controlling said temperature;

(f) a locking means secured to said body portion and engageable with said ink cartridge assembly for locking said ink cartridge assembly in position and preventing longitudinal movement of said ink cartridge assemble within said body portion of said marking head assembly;

(g) a cap assembly engageable with said body portion adjacent a first end of said ink cartridge assembly for supplying a predetermined volume of pneumatic pressure to said ink cartridge assembly; and (h) a marking tip assembly carried by a second end of said ink cartridge assembly.

10. A marking head assembly, according to claim 9, wherein said heat control means is a thermocouple.

11. A marking head assembly, according to claim 9, wherein said marking head assembly further includes a registration means connected to said body portion and engageable with said ink cartridge assembly for preventing rotation of said ink cartridge assembly.

12. A marking head assembly, according to claim 9, wherein said marking head assembly further includes an insulation cover surrounding said body portion of said marking head assembly.

13. A marking head assembly, according to claim 9, wherein said marking head assembly further includes an end cap disposed radially opposite said cap assembly secured to said body portion to provide insulation.

14. A marking head assembly, according to claim 9, wherein said marking head assembly further includes a plunger guard member disposed to cover a metallic end of said locking means for preventing heat transfer to said locking means.

* * * * *